US009332833B2

(12) United States Patent
Kim et al.

(10) Patent No.: US 9,332,833 B2
(45) Date of Patent: May 10, 2016

(54) PORTABLE CONFIGURABLE FURNITURE

(71) Applicants: Tae Wan Kim, San Francisco, CA (US); Kang S. Lim, San Ramon, CA (US)

(72) Inventors: Tae Wan Kim, San Francisco, CA (US); Kang S. Lim, San Ramon, CA (US)

(73) Assignee: Alite Designs, Inc., San Francisco, CA (US)

( * ) Notice: Subject to any disclaimer, the term of this patent is extended or adjusted under 35 U.S.C. 154(b) by 0 days.

(21) Appl. No.: 13/794,756

(22) Filed: Mar. 11, 2013

(65) Prior Publication Data

US 2014/0250593 A1 Sep. 11, 2014

(51) Int. Cl.

| | |
|---|---|
| ***A47B 3/04*** | (2006.01) |
| ***A47B 3/06*** | (2006.01) |
| ***A47B 3/087*** | (2006.01) |
| ***A61G 13/10*** | (2006.01) |
| ***A47C 1/14*** | (2006.01) |
| ***A47C 4/02*** | (2006.01) |
| ***A47C 4/04*** | (2006.01) |
| ***A47C 7/00*** | (2006.01) |
| ***A47C 17/64*** | (2006.01) |

(52) U.S. Cl.

CPC ... *A47B 3/04* (2013.01); *A47B 3/06* (2013.01); *A47B 3/087* (2013.01); *A47C 1/143* (2013.01); *A47C 4/024* (2013.01); *A47C 4/04* (2013.01); *A47C 7/008* (2013.01); *A47C 17/645* (2013.01); *A61G 13/105* (2013.01)

(58) Field of Classification Search

CPC ..... A47B 2220/09; A47B 2200/0064; A47B 3/00; A47B 3/087; A47B 3/04; A47B 3/06; A61G 13/105; A47C 17/64; A47C 17/645; A47C 1/143; A47C 7/008; A47C 4/04; A47C 4/024

USPC ..... 5/110–112, 114–117

See application file for complete search history.

(56) References Cited

U.S. PATENT DOCUMENTS

| | | | | | |
|---|---|---|---|---|---|
| 1,295,194 | A | * | 2/1919 | Parelius | 108/34 |
| 1,669,681 | A | * | 5/1928 | Stoutenburg | 5/112 |
| 2,023,870 | A | * | 12/1935 | Casott | 108/34 |
| 2,167,342 | A | * | 7/1939 | York | 108/35 |
| 2,200,193 | A | * | 5/1940 | Taylor | 297/22 |
| 2,217,658 | A | * | 10/1940 | De Puy | 211/132.1 |
| 2,638,394 | A | * | 5/1953 | Ulrich | 108/34 |
| 3,176,633 | A | * | 4/1965 | Balfour | 108/67 |
| 3,432,132 | A | * | 3/1969 | Thurston | 248/188.91 |
| 3,462,773 | A | * | 8/1969 | Triplett | 5/111 |
| 3,737,926 | A | * | 6/1973 | Hermanson | 5/191 |
| 4,034,518 | A | * | 7/1977 | Trecker | 5/114 |
| 4,333,638 | A | * | 6/1982 | Gillotti | 5/613 |
| 4,341,164 | A | * | 7/1982 | Johnson | 108/67 |
| 4,579,066 | A | * | 4/1986 | Zeigler | 108/159.12 |
| 4,833,998 | A | * | 5/1989 | Everett et al. | 108/36 |
| 4,943,041 | A | * | 7/1990 | Romein | 5/620 |
| 5,056,439 | A | * | 10/1991 | Hodge et al. | 108/34 |

(Continued)

*Primary Examiner* — Robert G Santos
*Assistant Examiner* — David R Hare
(74) *Attorney, Agent, or Firm* — Kang S. Lim

(57) ABSTRACT

The present invention relates to lightweight collapsible portable and configurable furniture. In one embodiment, a table includes a collapsible top with optional slat(s), a collapsible top support frame, a collapsible leg frame and leg extenders. The top support frame provides tension to the top. The leg frame is coupled to top support frame. The leg extenders extend independently from the leg frame to provide stability. In another embodiment, a cot includes collapsible top(s), corresponding pair(s) of support bars and legs. The legs are coupled to the support bar pairs to provide support and tension to the top(s).

9 Claims, 13 Drawing Sheets

(56) References Cited

U.S. PATENT DOCUMENTS 5,913,271 A * 6/1999 Lloyd ..... 108/132
6,000,345 A * 12/1999 Gillotti ..... 108/36
6,076,472 A * 6/2000 Lloyd ..... 108/36
6,079,338 A * 6/2000 Yeh ..... 108/115
6,378,445 B1 * 4/2002 Willard et al. ..... 108/115
6,431,086 B1 * 8/2002 Lloyd ..... 108/36
6,505,565 B1 * 1/2003 Byung et al. ..... 108/115
6,705,234 B1 * 3/2004 Miller et al. ..... 108/36

* cited by examiner

PORTABLE CONFIGURABLE FURNITURE

BACKGROUND

The present invention relates to systems and methods for portable configurable furniture. In particular, the invention relates to portable, lightweight and collapsible stable furniture well suited for camping and travelling.

Conventional portable furniture is not truly portable and easily configured for outdoor use and cannot accommodate usage on a hillside or uneven terrain. Examples of such portable furniture include folding chairs, folding tables and folding cots. Generally, the user are unable use most of these furniture comfortably, e.g., to sit comfortably on a hillside or on uneven terrain. Further, the user has to anticipate her/his needs ahead of time, and then lug a complete set of portable furniture into the field.

Thus, there is a need for portable and configurable furniture. These improved portable furniture need to be strong, lightweight, stable, collapsible and configurable, and to be well suited for use in the field, including on uneven terrain often encountered outdoors.

SUMMARY

To achieve the foregoing and in accordance with the present invention, systems and methods for constructing portable furniture is provided. In particular, the invention provides portable, lightweight, collapsible, stable and configurable furniture well suited for camping and travelling.

In one embodiment, a portable configurable table includes a collapsible top with one or more optional slats, a collapsible top support frame, a collapsible leg frame and a plurality of leg extenders. The collapsible top support frame provides tension to the top. The collapsible leg frame is operatively coupled to top support frame, and the leg frame includes a plurality of stabilizers and a cross member. The plurality of leg extenders are configured to independently extend from the leg frame thereby providing stability on uneven ground.

In some embodiments, the top support frame includes a couple of hinges and is configured to fold thereby providing compactness when disassembled, and configured to unfold thereby providing tension to the top. The slats can be coupled to the top by adhesive or Velcro. Alternatively, the top can include at least one slot configured to accommodate the optional slats. The top support frame and/or the leg frame can include at least one elastic cord configured to guide assembly.

In another embodiment, a portable configurable cot includes one or more collapsible tops, one or more corresponding pairs of support bars configured to provide support to the tops and at least two legs. Each of the two legs are configured to be operatively coupled to at least one pair of the at least one pair of support bars thereby providing tension to the at least one top.

Note that the various features of the present invention described above may be practiced alone or in combination. These and other features of the present invention will be described in more detail below in the detailed description of the invention and in conjunction with the following figures.

BRIEF DESCRIPTION OF THE DRAWINGS

In order that the present invention may be more clearly ascertained, some embodiments will now be described, by way of example, with reference to the accompanying drawings, in which.

DETAILED DESCRIPTION

The present invention will now be described in detail with reference to several embodiments thereof as illustrated in the accompanying drawings. In the following description, numerous specific details are set forth in order to provide a thorough understanding of embodiments of the present invention. It will be apparent, however, to one skilled in the art, that embodiments may be practiced without some or all of these specific details. In other instances, well known process steps and/or structures have not been described in detail in order to not unnecessarily obscure the present invention. The features and advantages of embodiments may be better understood with reference to the drawings and discussions that follow.

The present invention relates to systems and methods for constructing portable, lightweight, collapsible, stable and configurable furniture well suited for camping and travelling. To facilitate discussion, FIGS. 1A to 7 illustrate several embodiments of portable and configurable furniture in accordance to the present invention.

I. Portable Configurable Tables

Figure 1A:
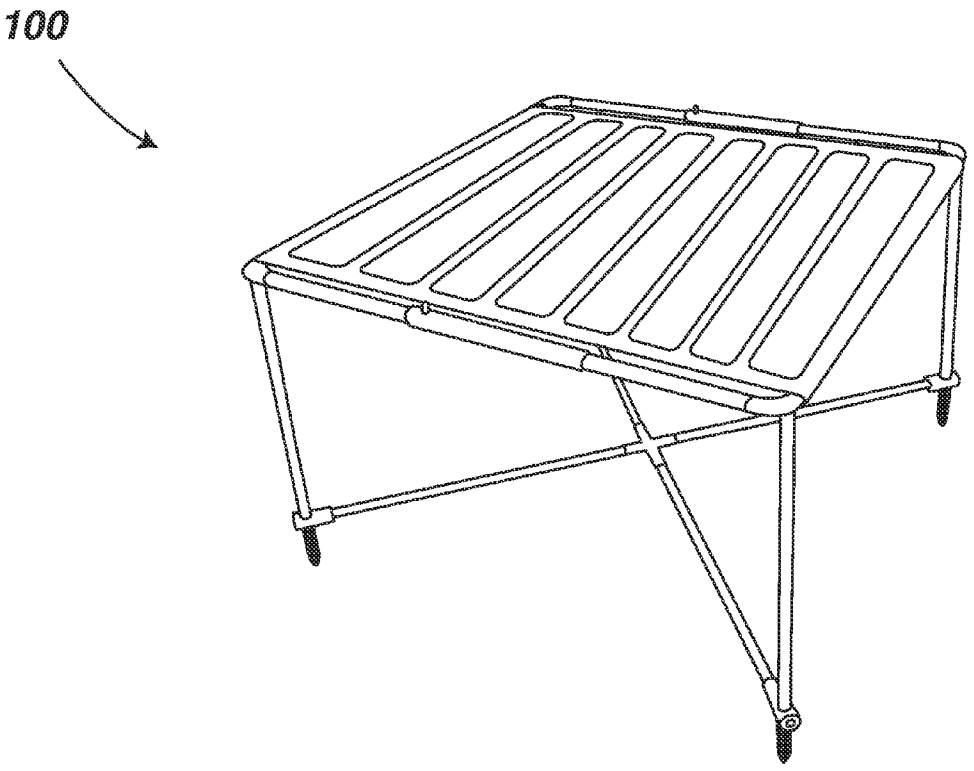
FIGS. 1A and 1B are perspective and exploded views of an exemplary embodiment of a portable and configurable table, in accordance with the present invention.
Figure 1B:
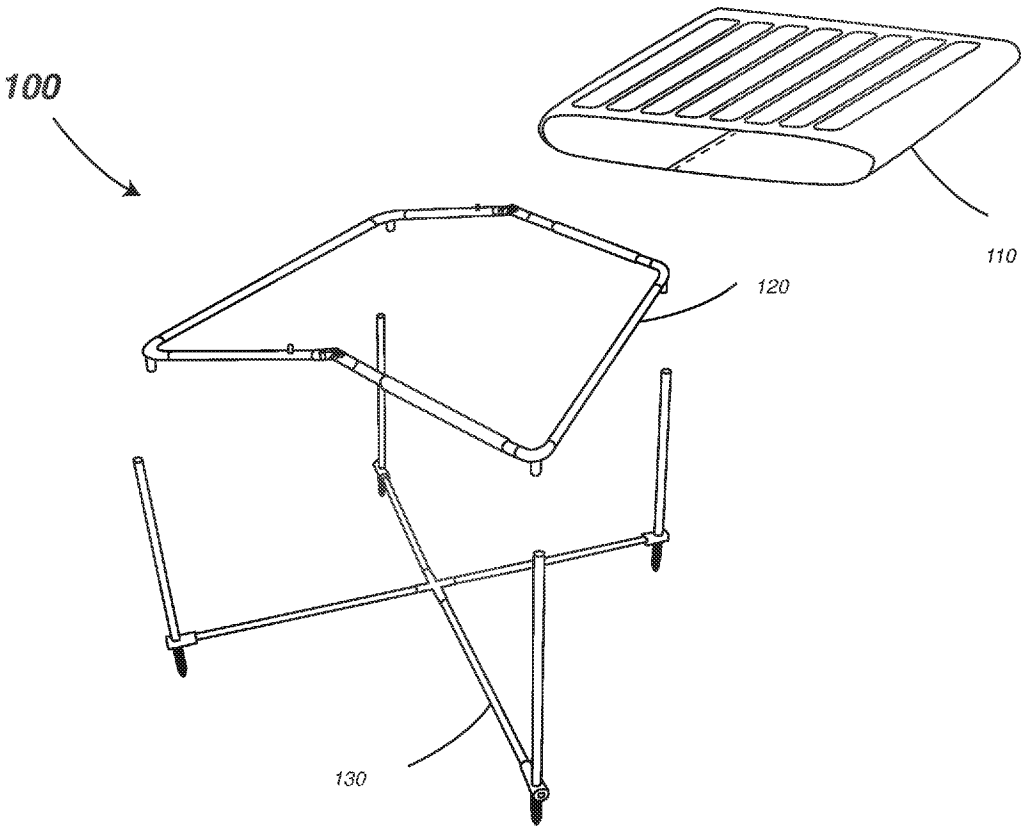

As shown in FIGS. 1A and 1B, the portable and configurable table 100 includes a collapsible top 110, a top support frame 120 and a leg frame 130 configured to provide at least three points of contact with a ground surface (not shown). Top support frame 120 is configured to slide inside and provide tensioning for collapsible top 110. Leg frame 130 is configured to be coupled to the corners of top support frame 120.

Figure 2A:
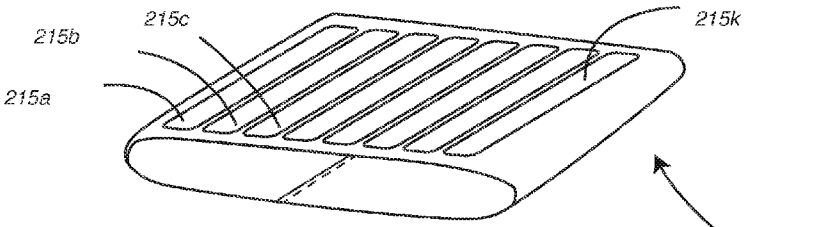
FIGS. 2A to 2F illustrate alternate embodiments of collapsible tops for the embodiment of FIG. 1A.
Figure 2B:
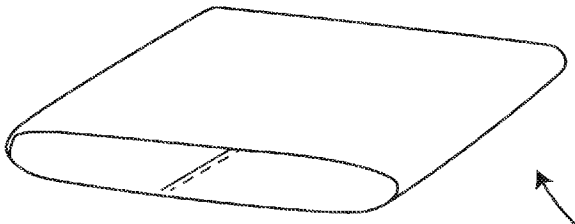
Figure 2C:
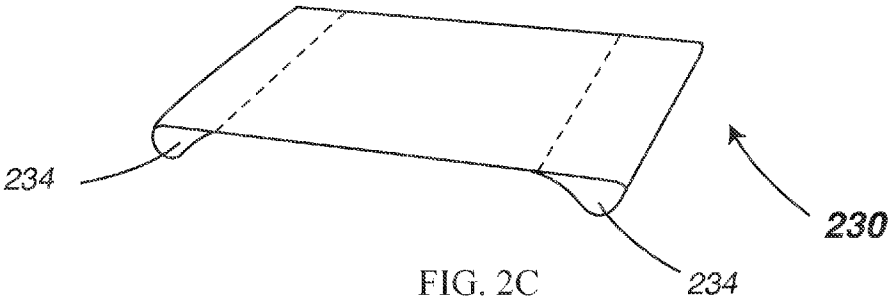

FIGS. 2A to 2F are perspective views illustrating alternate embodiments of tops 110, 220, 230, 240, 250 and 260 for the portable table 100. Tops 110, 220, 230 . . . 260 can be made from a variety of suitable natural and/synthetic materials such as canvas, polyester and Gore-Tex and nylon. As shown in FIG. 2A, a plurality of optional stiffening slats 215*a*, 215*b*, 215*c* . . . 215*k* can be secured to top 110 by, for example, adhesive, Velcro, rivets and/or stitching. Slats 215*a*, 215*b*, 215*c* . . . 215*k* can be made from suitable materials including plastic, wood, bamboo, metals, composites and resin-impregnated materials such as carbon fiber and fiberglass. Accordingly, reinforced top 110 is more stable and capable of supporting glassware filled with fluids thereby reducing the risk of spillage.

Figure 2D:
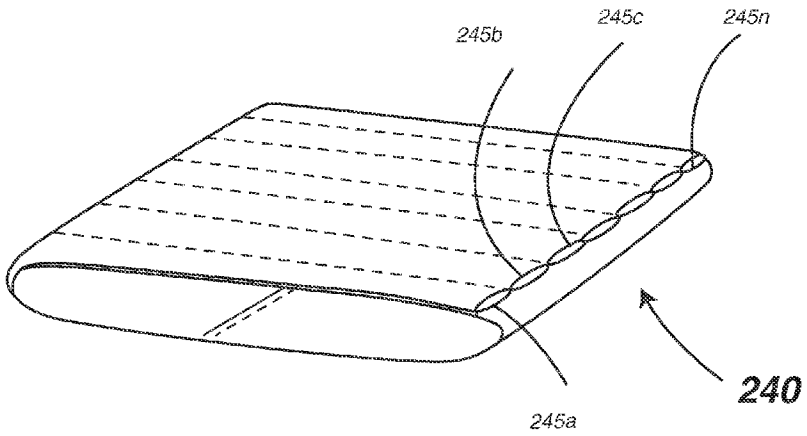
Figure 2E:
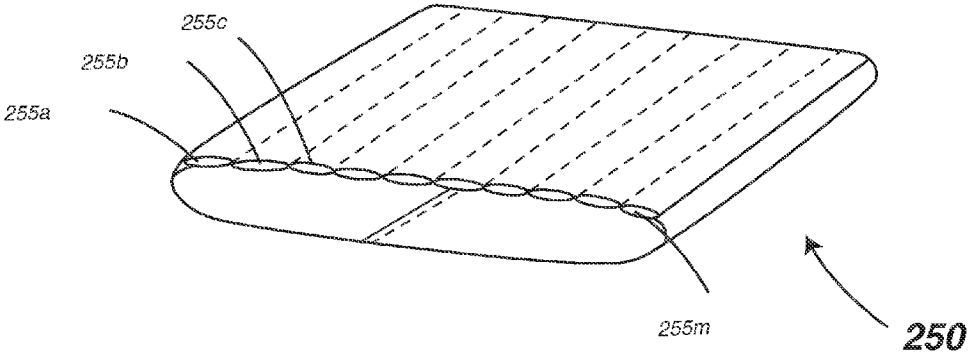
Figure 2F:
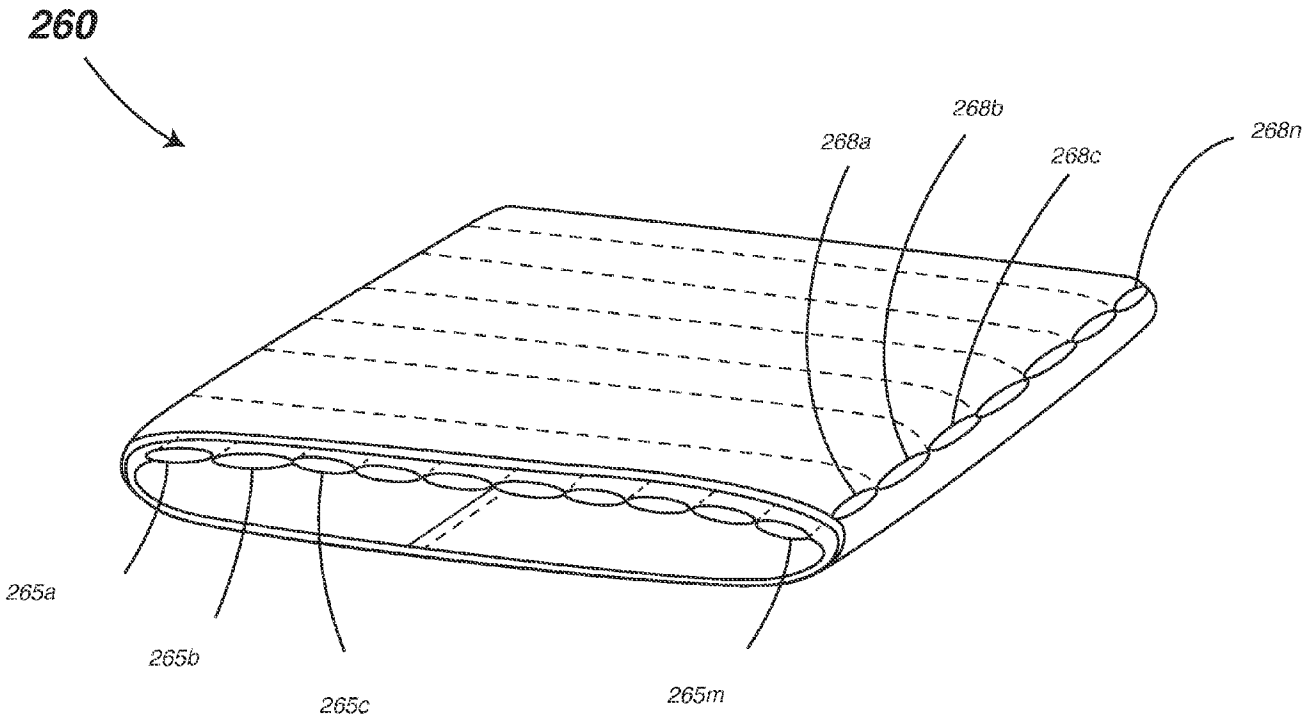

FIGS. 2D, 2E and 2F are perspective views of alternate embodiments of tops 240, 250 and 260 incorporating a plurality of slots configured to accommodate a plurality of stiffening slats (not shown). For example, top 240 includes a plurality of slots 245*a*, 245*b*, 245*c* . . . 245*n* formed by, for example, stitching pockets using two or more layers of a suitable material. Similarly, top 250 includes a plurality of slots 255*a*, 255*b*, 255*c* . . . 255*m* for accommodating stiffening slats. As shown in FIG. 2F, top 260 includes a first plurality of slots 265*a*, 265*b*, 256*c* . . . 265*m* having a first orientation, and further includes a second plurality of slots 268*a*, 268*b*, 268*c* . . . 268*n* having a second orientation, thereby substantially improving the stability and load capability of top 260.

Figure 3A:
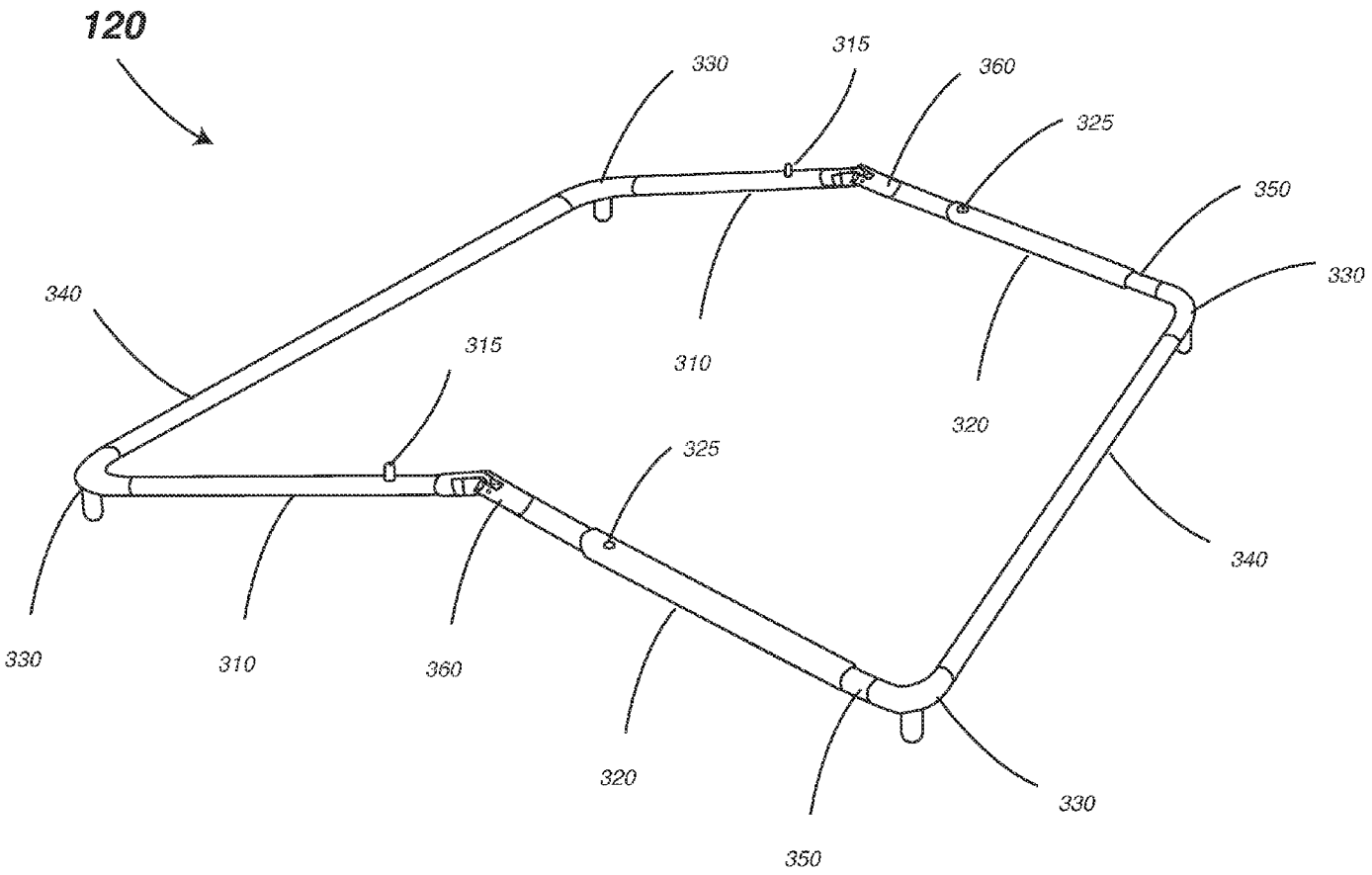
FIGS. 3A and 3B are perspective and exploded views of an exemplary top support frame for the embodiment of FIG. 1A.
Figure 3B:
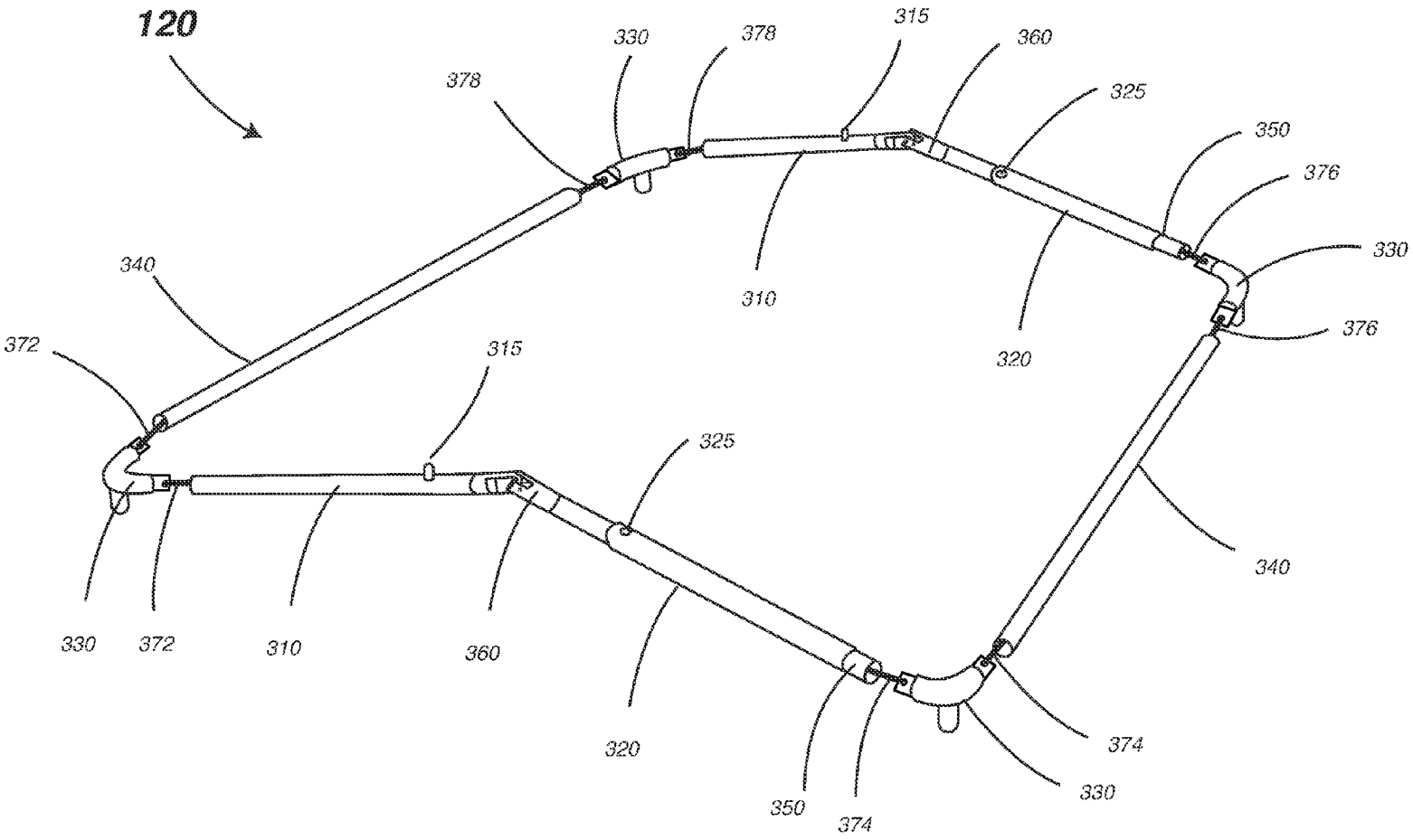

Referring now to FIGS. 3A and 3B, perspective and exploded views illustrate exemplary top support frame 120 having two substantially parallel pairs of hinged bars 310, 350 coupled to each other via hinges 360, two substantially parallel bars 340 and four corner joints 330. The bar pairs 310, 350 are coupled to corresponding bars 340 via the corresponding corner joints 330, and further configured to be assembled and disassembled with the guidance of one or more elastic and/or static cords 372, 374, 376, 378. During the assembly process, hinged bars 310 and 320 can be straightened out to provide tension to top 110. Frame 120 can be stabilized by sliding sleeves 320 towards and over hinges 360 and secured by aligning the respective buttons 315 and holes 325. Upon assembly, bars 310, 350 and bars 340 substantially form a rectangular shape.

Figure 4A:
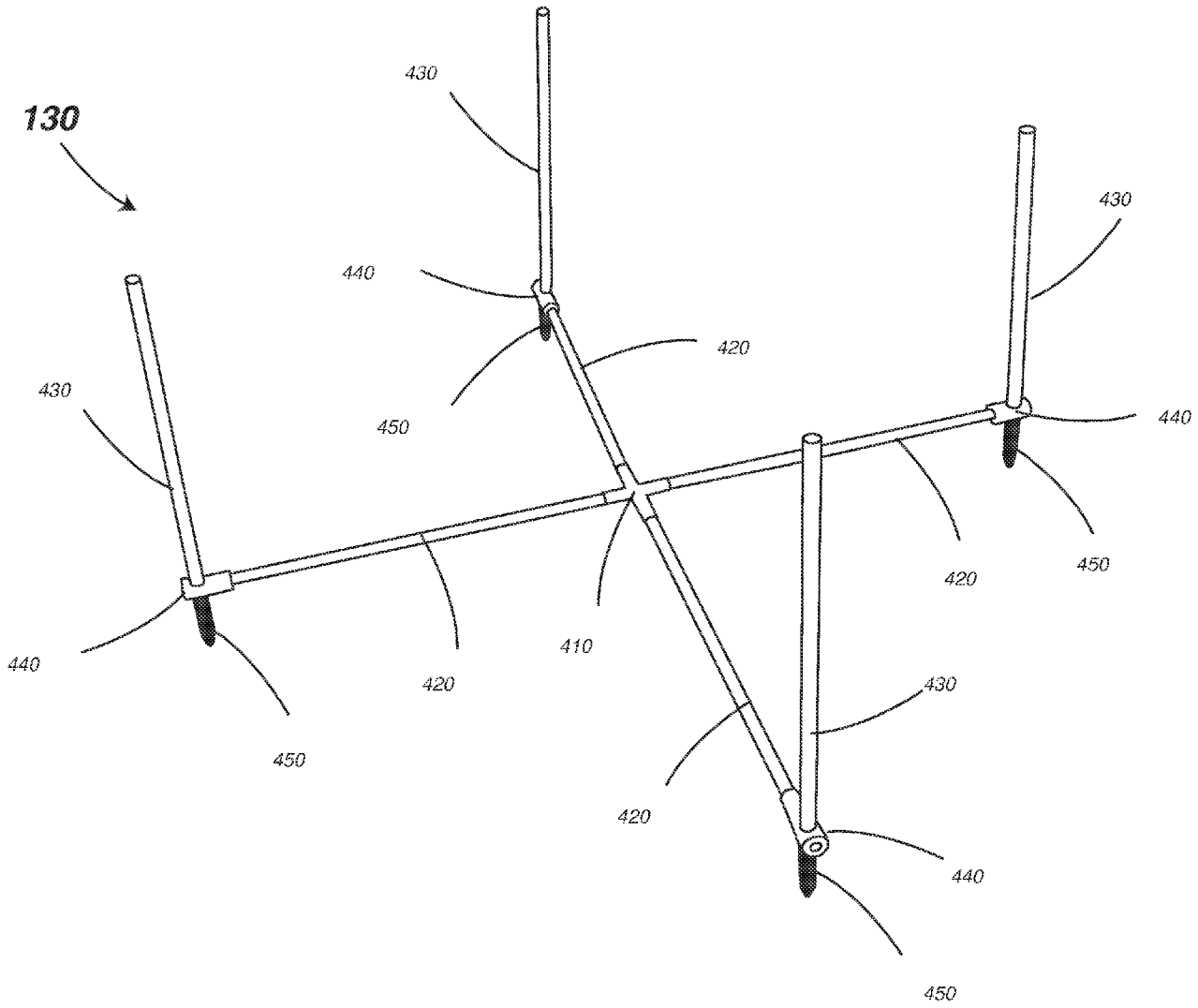
FIGS. 4A and 4B are perspective and exploded views of an exemplary leg frame for the embodiment of FIG. 1A.
Figure 4B:
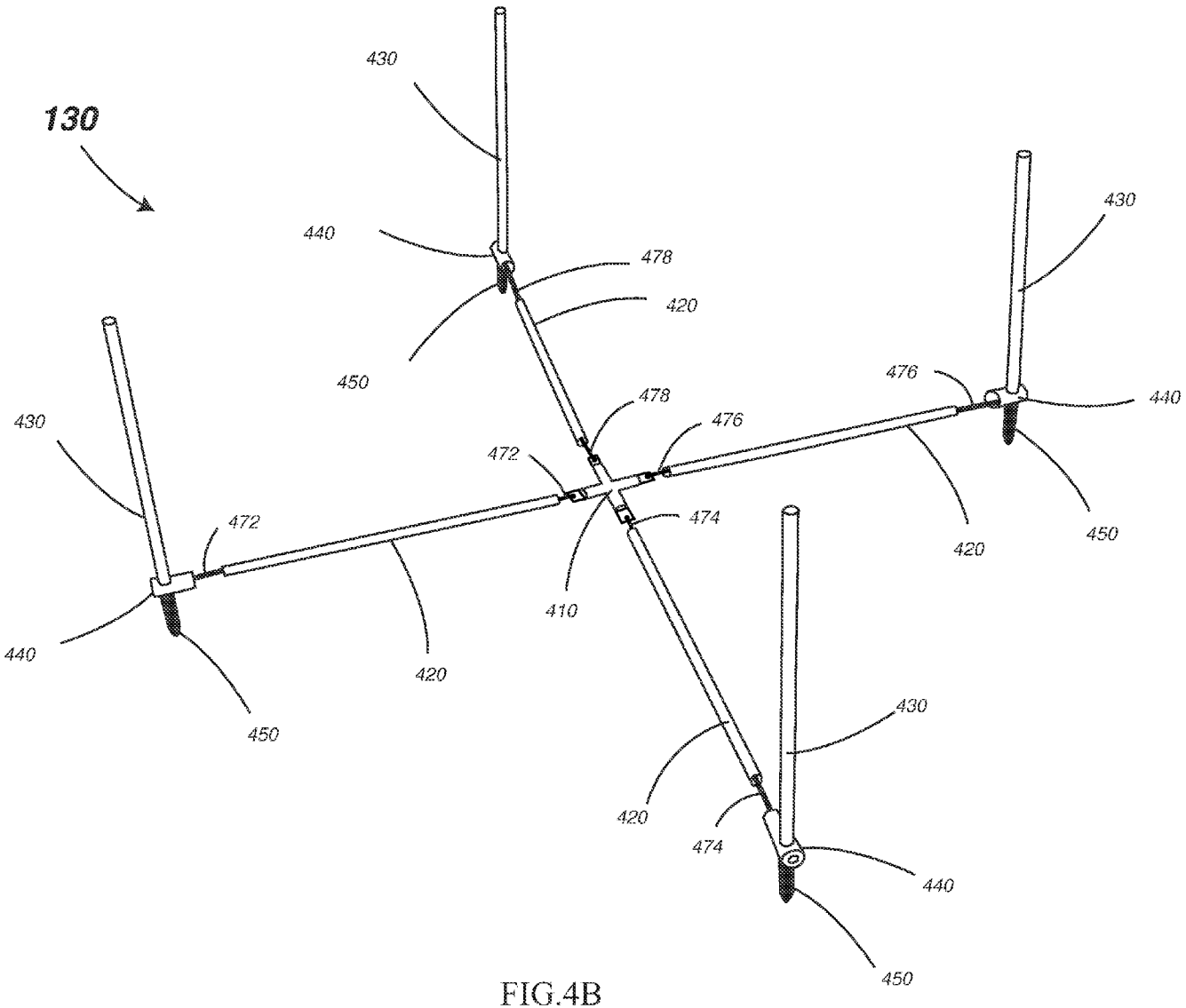

As shown in the perspective and exploded views of FIGS. 4A and 4B, exemplary leg frame 130 include a cross member 410, four stabilizers 420, four legs 430 coupled to respective extension joints 440, and four leg extenders 450. Each stabilizer 420 is configured to be assembled between cross member 410 and a corresponding extension joint 440, and further configured to be assembled and disassembled with the guidance of one or more cords 472, 474, 476, 478, respectively. Leg extenders 450 are coupled to corresponding legs 430, and configured to be independently adjustable with respect to legs 430, thereby enabling the user to level the table 100 on a hillside or on uneven terrain.

Note that frame 120 is further stabilized when the bottom protrusions, e.g., male or female, of corner joints 330 are secured to the corresponding mating interfaces located on the top of legs 430. As discussed above, frames 120, 130 can include cords, e.g., cords 372 . . . 378 and cords 472 . . . 478, configured to run through the respective structures and function to pull the bar sections, legs, and/or joints together. The cords 372 . . . 378 and cords 472 . . . 478 can be elastic and/or cords, but may alternatively be any other suitable material such as fabric, plastic, metal, or a metal spring.

The frames 120, 130 can be one of several variations. For example, bars 340 (and/or stabilizers 420) can be cylindrical rods, but may alternatively have any suitable geometry and may have varying geometries along their respective length. The bars are straight or linear bars, but may alternatively be curved, bent, or have any other suitable geometry. The bars can be made of metal (such as 7075 T9 aluminum tubes (and/or rods) with a diameter of approximately 0.4" to 1.0" and a wall thickness of approximately 0.03" to 0.15"), or plastic, but may be alternatively made from any suitable material. The bars may be collapsible or foldable such that they include multiple sections that can be assembled to support the sling and the weight of the user and can be disassembled for easy transportation and storage. Each of the bars can be straight, but may alternatively be curved or angled. Each bar may have the same radius of curvature or angle, but alternatively each bar may have a different radius of curvature or angle. Further, exemplary bars 340 and stabilizers 420 can be a single section or comprise multiple sections.

II. Portable Configurable Cots

Figure 5A:
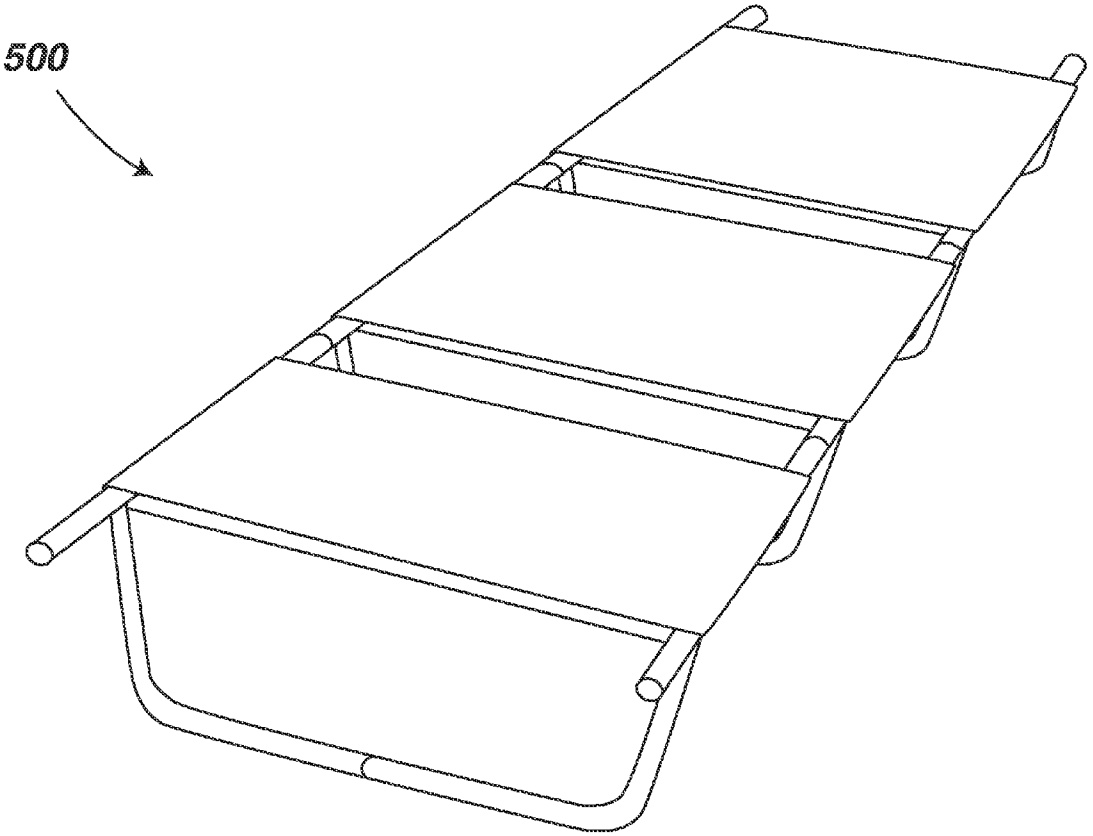
FIGS. 5A and 5B are perspective and exploded views of an exemplary embodiment of a portable and configurable cot, in accordance with the present invention.
Figure 5B:
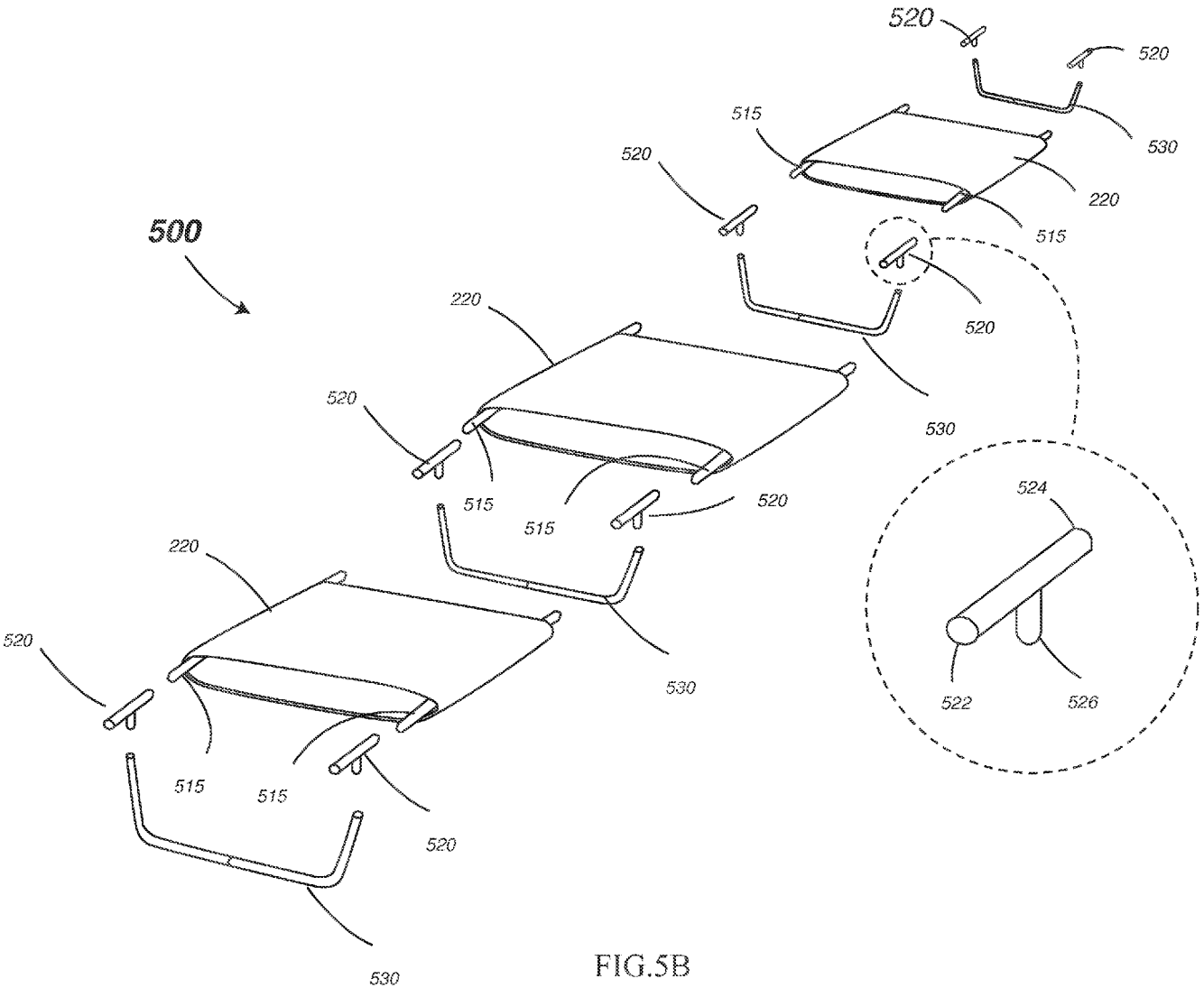

In this embodiment, as illustrated by FIGS. 5A and 5B, cot 500 can be configured using one or more of the tops described above, for example, tops 220 to 260. In this example, cot 500 includes three tops 220, three pairs of support bars 515, four legs 530, and four sets of couplers 520. Each coupler 520 includes substantially horizontal interfaces 522, 524, e.g., male or female, for securing the support bars 515 to each other, thereby forming a substantially flat platform well suited for the user to sleep on. Each coupler 520 also includes a substantially vertical interface 526, e.g., male or female, for securing the support bars 515 to legs 530, and also to provide tension to the tops.

As discussed above, tops can include slots for suitable inserts. Accordingly when tops are configured for a cot, one or more foam strips can be inserted in the slots of tops, e.g., top 250, for additional support and also to provide insulation in cooler weather. Other suitable supporting and/or insulating materials for the strips are also contemplated. Although three tops are described for cot 500 to accommodate the average user, it is also possible to assemble cots with one top, two tops, and four tops for a toddler, a child and a tall person.

The components of cot 500, e.g., support bars 515 (and legs 530) can be cylindrical rods, but may alternatively have any suitable geometry and may have varying geometries along their respective length. The bars are straight or linear bars, but may alternatively be curved, bent, or have any other suitable geometry. The bars can be made of metal (such as 7075 T9 aluminum tubes (and/or rods) with a diameter of approximately 0.4" to 1.0" and a wall thickness of approximately 0.03" to 0.15"), or plastic, but may be alternatively made from any suitable material. The bars may be collapsible or foldable such that they include multiple sections that can be assembled to support the sling and the weight of the user and can be disassembled for easy transportation and storage. Each of the bars can be straight, but may alternatively be curved or angled. Each bar may have the same radius of curvature or angle, but alternatively each bar may have a different radius of curvature or angle. Further, exemplary support bar 515 can be a single section or comprise multiple sections.

In some embodiments (not shown), legs may be adjustable height-wise to accommodate uneven ground surfaces. Alternatively, rubber bumpers of different thicknesses may also be added to the bottom of legs 530 to accommodate uneven ground. The components of cot 500 may also include cords (not shown) configured to run through the respective structures and function to pull the bars, legs, and/or joints together. These cords can be elastic and/or static cords, but may alternatively be any other suitable material such as fabric, plastic, metal, or a metal spring.

III. Additional Embodiments of Portable Configurable Furniture

Figure 6:
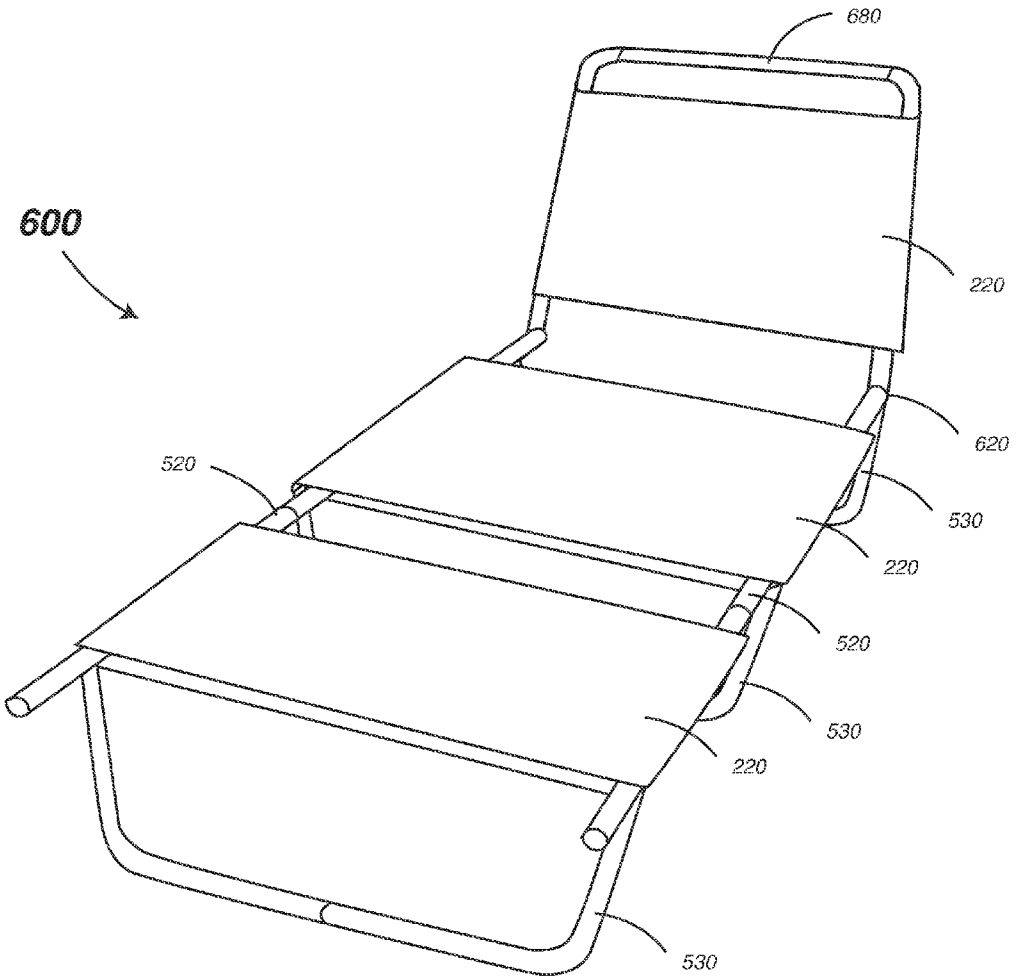
FIG. 6 is a perspective view of an exemplary embodiment of a portable and configurable lounge chair, in accordance with the present invention.
Figure 7:
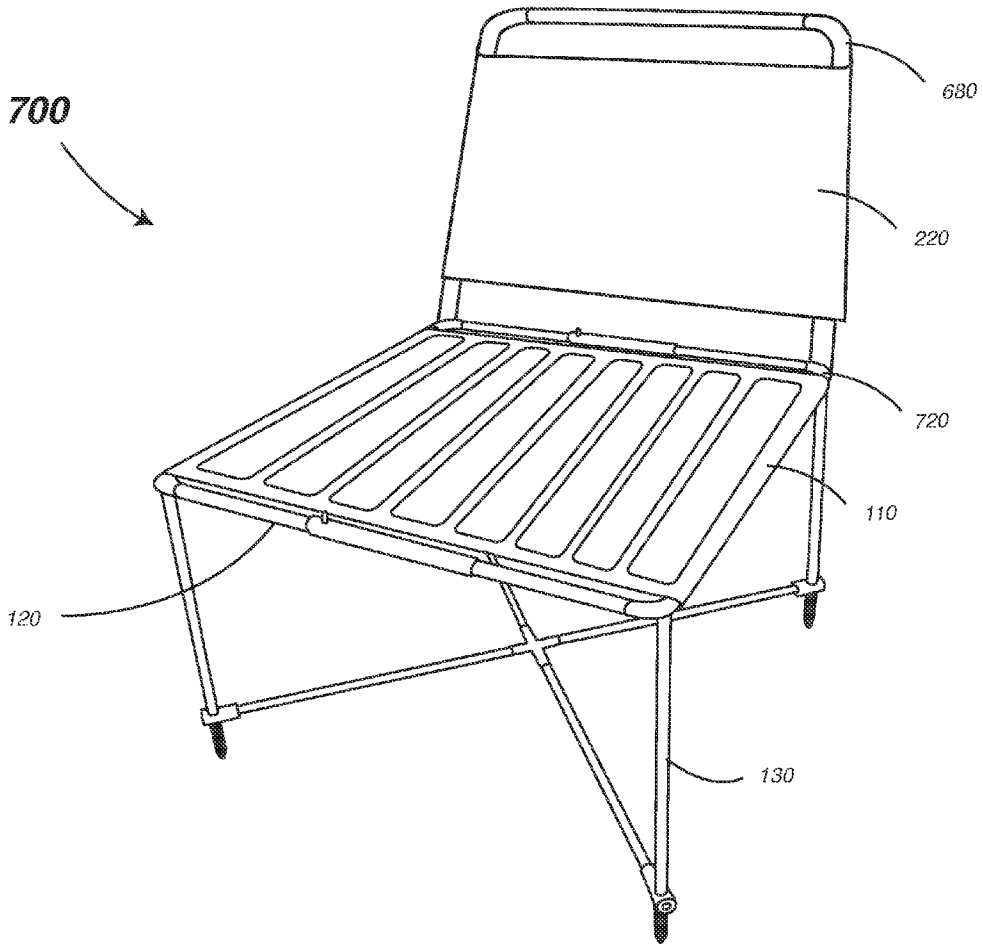
FIG. 7 is a perspective view of an exemplary embodiment of a portable and configurable upright chair, in accordance with the present invention.

FIGS. 6 and 7 are perspective views illustrating two additional embodiments of a lounge chair 600 and an upright chair 700, reconfigured using the construction techniques described above and using some of the components of table 100 and cot 500, together with a top bar 680 and a pair of joints 620 and 720, respectively.

The components of exemplary chairs 600, 700 may also include cords (not shown) configured to run through the respective structures and function to pull the bars, legs, and/or joints together. These cords can be elastic and/or static cords, but may alternatively be any other suitable material such as fabric, plastic, metal, or a metal spring.

Many modification and additions to the above described embodiments are also possible. For example, instead of the "fabric-like" top 110 described above, a more "solid" top can be made from strips of a suitable stiff material, such as wood or plastic, suitably "hinged" together along the respective sides, thereby eliminating the need for a supporting fabric-like material.

While this invention has been described in terms of several embodiments, there are alterations, modifications, permutations, and substitute equivalents, which fall within the scope of this invention. Although sub-section titles have been provided to aid in the description of the invention, these titles are merely illustrative and are not intended to limit the scope of the present invention. It should also be noted that there are many alternative ways of implementing the methods and apparatuses of the present invention. It is therefore intended that the following appended claims be interpreted as including all such alterations, modifications, permutations, and substitute equivalents as fall within the true spirit and scope of the present invention.

What is claimed is:

1. A portable configurable table comprising:

a collapsible top support frame having a first bar and a second rigid bar, the first and second bars substantially parallel with respect to each other, the top support frame further includes a first pair and a second pair of hinged bars perpendicularly coupled to the first and second rigid bars;

a removable collapsible table top configured to form one contiguous flexible loop enclosing both the first bar and the second bar of the top support frame, and wherein the first and second pairs of hinged bars configured to straighten and form corresponding parallel bars thereby enabling the first and second rigid bars to provide opposing tension via the first and second bars to the table top thereby internally tensioning the contiguous flexible loop of the top to form a substantially flat support surface;

a plurality of reinforcing slats configured to be operatively coupled to and to provide rigidity to the collapsible table top;

a collapsible leg frame configured to be operatively coupled to top support frame, and wherein the leg frame includes a plurality of legs and a corresponding plurality of diagonal stabilizers oriented in a substantially horizontal plane and configured to be coupled to each other by a centrally-located X-shaped cross member oriented in the horizontal plane, and wherein each of the plurality of diagonal stabilizers is further configured to be coupled a corresponding one of the plurality legs, thereby forming an X-shaped diagonal reinforcing structure for the plurality of legs; and a plurality of leg extenders configured to independently extend from the leg frame thereby providing stability on uneven ground.

2. The table of claim 1 wherein the top includes a plurality of slots configured to accommodate the plurality of slats.

3. The table of claim 1 wherein the plurality of slats are configured to be operatively coupled to the top by adhesive or a hook and loop interface.

4. The table of claim 1 wherein the top support frame comprises at least one cord configured to guide assembly of the support frame.

5. The table of claim 4 wherein the at least one cord is at least one of an elastic cord and a static cord.

6. The table of claim 1 wherein the leg frame comprises at least one cord configured to guide assembly of the leg frame.

7. The table of claim 6 wherein the at least one cord is at least one of an elastic cord and a static cord.

8. The table of claim 1 wherein the plurality of reinforcing slats are substantially contiguous with respect to each other.

9. The table of claim 2 further comprising a second plurality of reinforcing slats, wherein the top includes a second plurality of slots configured to accommodate the second plurality of reinforcing slats, and wherein the second plurality of slots are oriented substantially perpendicularly to the plurality of slots.

* * * * *